US007604065B2

(12) United States Patent
Neumeier et al.

(10) Patent No.: US 7,604,065 B2
(45) Date of Patent: Oct. 20, 2009

(54) PROCESS AND DEVICE FOR EXTINGUISHING METAL FIRES

(75) Inventors: Anton Neumeier, Mering (DE); Reinhard Effenberger, Affing (DE)

(73) Assignee: HNE Technologie AG, Augsburg (DE)

( * ) Notice: Subject to any disclaimer, the term of this patent is extended or adjusted under 35 U.S.C. 154(b) by 914 days.

(21) Appl. No.: 10/897,693

(22) Filed: Jul. 23, 2004

(65) Prior Publication Data

US 2005/0077056 A1 Apr. 14, 2005

(30) Foreign Application Priority Data

Sep. 8, 2003 (DE) ..... 103 41 382

(51) Int. Cl.
*A62C 2/00* (2006.01)
*A62C 11/00* (2006.01)

(52) U.S. Cl. ..... 169/43; 169/30; 169/71

(58) Field of Classification Search ..... 169/43, 169/44, 45, 46, 47, 5, 6, 9, 16, 30, 71, 85; 239/525, 526, 532, 302, 310
See application file for complete search history.

(56) References Cited

U.S. PATENT DOCUMENTS 3,698,482 A * 10/1972 Livingston ..... 169/16
3,727,841 A * 4/1973 Hengesbach ..... 239/145
5,124,367 A * 6/1992 Barker et al. ..... 521/107
5,607,787 A * 3/1997 Wedlake et al. ..... 429/62
5,871,673 A * 2/1999 Nakagami ..... 252/580
6,540,163 B1 * 4/2003 Huang ..... 239/587.5
6,719,331 B1 * 4/2004 Chen ..... 285/302

* cited by examiner

*Primary Examiner*—Davis Hwu
(74) *Attorney, Agent, or Firm*—Klaus J. Bach

(57) ABSTRACT

In a process and device for extinguishing metal fires, a totally water-free liquid which reacts with the extinguished metal to form a silicate covering the metal fire source is used as extinguishing agent.

4 Claims, 1 Drawing Sheet

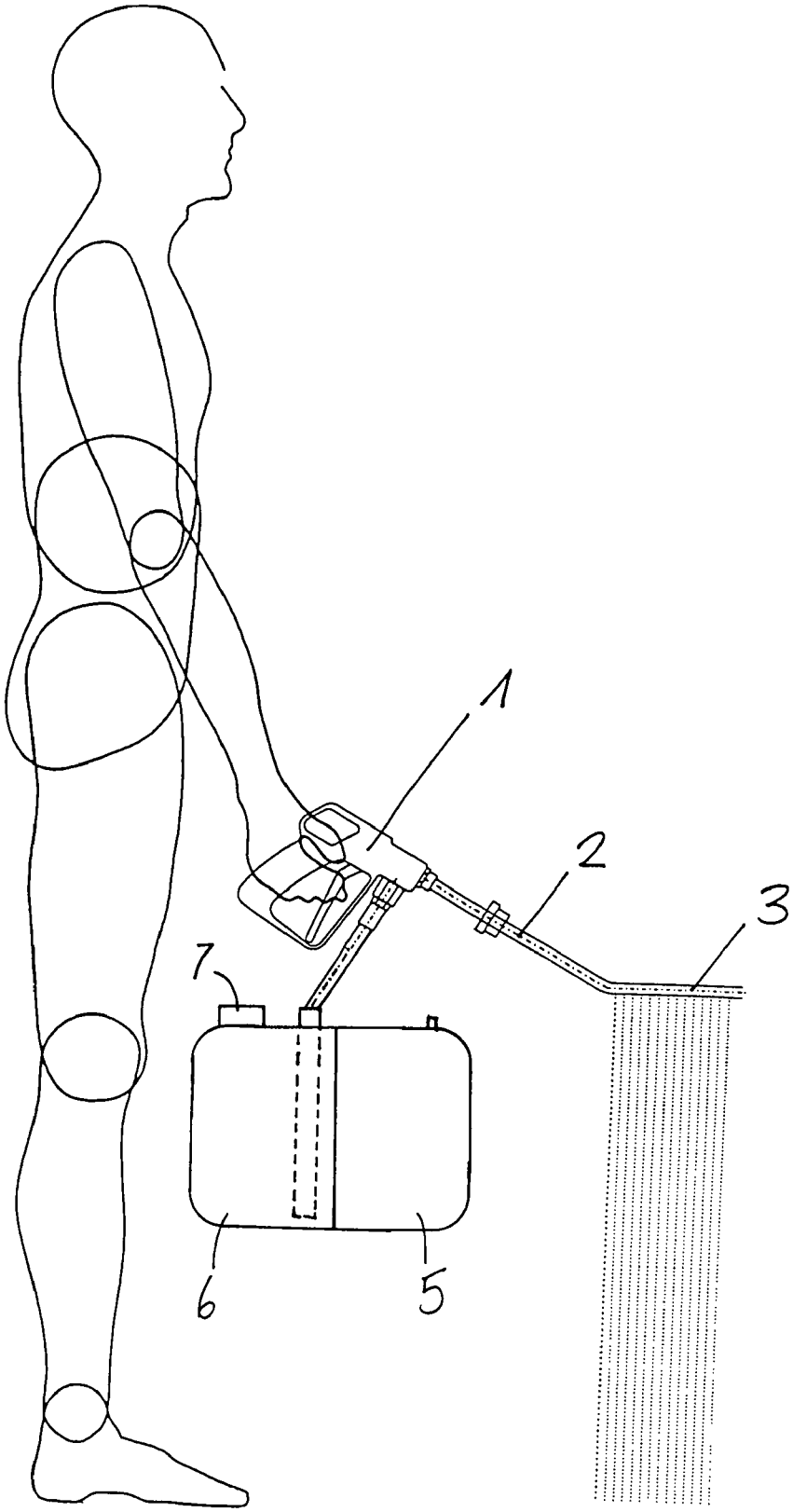
1
2
3
7
6
5

PROCESS AND DEVICE FOR EXTINGUISHING METAL FIRES

BACKGROUND OF THE INVENTION

The invention relates to a process and device for extinguishing metal fires by application of an extinguishing agent to the fire source.

Metal fires, namely fires of the fire class D (Magnesium alloys, aluminum alloys, lithium alloys, sodium, etc.) pose a serious problem in fire fighting. The reason for this lies in the strong reaction of these metals (in particular alkali metals) with even minute quantities of water. Even a high relative humidity of the surrounding air is sufficient to accelerate the combustion process.

Metals involved in metal fires are particularly the alkali metals sodium, potassium, lithium, and cesium, the metals magnesium, calcium and barium which also react violently with water, and the metals aluminum, cerium, iridium, niobium, palladium and also magnesium oxide.

Due to the increased technical use of such metal alloys, for example in the automotive sector, the problem of fire fighting has been considerably amplified as even chippings which occur during metal-removing shaping of components of such alloys constitute a considerable fire risk. Car manufacturers worldwide are currently working on the increased use of magnesium components in vehicles, for example, in engines, gear-boxes, axles, doors, etc. The result is that in traffic accidents with such vehicles today and in particular in the future, there is an increased risk of fire with the major problem that, at present, the emergency forces cannot fight such fires in a targeted manner. The fire fighting services have presently no suitable extinguishing agents for effective action against fires of this type.

The combustion temperatures of the above metal alloys lie far above 2000° C. On contact with water this leads to dissociation of the water molecules, which are split into hydrogen and oxygen. This splitting can lead to gas explosions, which constitutes an additional potential risk.

Fighting metal fires with the extinguishing agents, which are known today, does not involve a true extinguishing process but merely the covering of a fire source, because of the nature of the extinguishing agents used until now. Extinguishing agents used at present are salt (sodium chloride—potassium chloride), extinguishing powder fire class D, sand and grey cast iron chippings. These can only be used to cover the burning metal. No extinguishing process as such is possible at present with any of these agents. If the burning metal is however merely covered by the extinguishing agent, the fire extinguishing process can take several hours or even days. This is an unacceptable situation for metal workers.

The use of the extinguishing powders which are known so far has the further disadvantage that pollution of the production plant occurs to a very high degree if a fire must be extinguished in the area of the plant. This calls for time-consuming and expensive clean-up work and hence long downtimes of the costly production equipment. Furthermore, the dust formation from fire fighting with powder results in a corresponding health risk for the fire fighters, as the fine powder dust remains in the lungs after inhalation and cannot be removed.

Grey cast iron chippings as a covering agent for metal fires also have considerable inadequacies in handling. Major German car manufacturers keep large quantities of grey cast iron chippings for any metal fires. A considerable problem connected with grey cast iron chippings however is the occurrence of corrosion by air oxygen. When these rusty chips are applied for example to burning magnesium chippings, this in turn lead can to undesirable reactions. These reactions are attributable to the iron oxide (rust has the chemical formula FeO(OH)). When heated to a high temperature, water is released and this water from the iron oxide in turn leads to corresponding reactions with the magnesium.

A similar problem arises with sand as an extinguishing agent, which therefore must be stored under absolutely dry conditions. Damp sand leads to the same phenomena as oxidized grey cast iron chippings.

It is therefore the object of the present invention to provide a process and a device for extinguishing metal fires with which the problems indicated can be avoided at least to a considerable extent.

SUMMARY OF THE INVENTION

In a process and device for extinguishing metal fires, a totally water-free liquid which reacts with the extinguished metal to form a silicate covering the metal fire source is used as extinguishing agent.

In contrast to the prior art, the invention works with a liquid extinguishing agent, which is totally water-free and hence is not subject to the risk of fire acceleration in the case of metals which react to water. The liquid extinguishing agent also has no components which, by dissociation or any other reaction during the extinguishing process could constitute a risk potential.

The liquid extinguishing agent used in the process according to the invention in essence comprises polydimethyl-siloxane with a proportion of solids and perfluoropolyether. It is constructed so that it contains no water constituents. Thus it is possible to extinguish the metal fires described above without a chance of dissociation of water or other hazardous reactions occurring during the extinguishing process.

The extinguishing principle of this liquid extinguishing agent is based on the fact that the polydimethyl-siloxane leads to the formation of silicate which is triggered by the thermal decomposition of the alkali metals or alkali metal compounds and the presence of fire-promoting air oxygen.

For the example of sodium, the following reaction formula is obtained:

$$R—[(CH_3)_2Si—\underline{O}—Is(CH)_32]_n+2n\mathrm{Na}+\tfrac{1}{2}nO_2\rightarrow 2nR—(CH_3)_2Si—O_2(-)+2n\mathrm{Na}^{9+})$$

Where R indicates the rest and n the length of the polymer chain.

Generally, expressed the reaction formula reads:

Polydimethysiloxane+alkali metal+ oxygen→dimethyl-silicate of the alkali metal.

This silicate formation provides for effects essential for the success of the extinguishing process:

consumption of the combustion-promoting oxygen consumption of the burning alkali metal, and formation of a vitrified layer over the source of the fire.

The first two effects, namely the consumption of oxygen and the consumption of alkali metal, minimize the available quantity of combustible or fire-promoting substance, and the latter effect, namely the formation of a vitrified layer over the fire source, at the same time, blocks the access of new air oxygen. Furthermore, the formed vitrified layer leads to a rapid cooling of the fire source due to the relatively good heat conduction.

The above-mentioned proportion of solids in the polydimethyl-siloxane can for example be formed by melanin or boron and should amount to a maximum of 10% of the volume. This proportion of solids helps slow down the undesirable reactions when covering the fire source.

As stated above, the liquid extinguishing agent can also contain perfluoropolyether. This is not involved in the silicate formation reaction described above but has a great cooling effect which is known to be extremely important in fire-fighting.

It is also essential for the process according to the invention that liquid extinguishing agents are applied to the burning metal in carefully metered quantities. If too much of the liquid extinguishing agent is applied, for example, in the form of a surge or full jet, e.g., onto burning or liquid sodium, it can possibly result in a reaction with the liquid metal with the result that the fire becomes uncontrollable. It is also essential that, on application of the liquid extinguishing agent to the burning metal, for example, magnesium chippings, the quantity of extinguishing agent applied stands in a particular ratio to the mass of the metal so that no undesirable reactions of the burning metal can be provoked. The extinguishing intensity I as the quantity of extinguishing agent applied per time unit can be defined as follows:

$$\text{Extinguishing intensity } I = V_{extinguishing\ agent} / t_{extinguishing} \times A_{fire}$$

Where I is the extinguishing intensity V, the quantity of extinguishing agent (volume), t the extinguishing time (application period) and A of the fire area.

These criteria are taken into account in that, according to the process of the invention, the liquid extinguishing agent is applied to the fire source in the form of a fine jet.

As the liquid extinguishing agent described above has a relatively high viscosity of 100 to 350 mPas, with the process according to the invention this leads to a correspondingly high application pressure to produce the fine jet of extinguishing agent if a wide range is to be provided.

For performing the process according to the invention the extinguisher works with an operating pressure of at least 10 bar. Thus, with the liquid extinguishing agent, a spray range of around 4 m can be achieved, which provides for a greater safety margin for the user during the extinguishing process. Previously known metal fire extinguishing agents (powder extinguishers) have a range of only a maximum of around 0.5 m so that the user is in great danger because he is in immediate vicinity of the fire source.

The extinguisher used to perform the process according to the invention can have a fire extinguisher working with a charge pressure, with an extinguishing agent container in which the liquid extinguisher agent is exposed to the corresponding operating pressure, an extinguishing agent hose and an extinguishing agent head with a nozzle device which generates a multitude of fine jets of extinguishing agent which are preferably directed approximately vertically onto the surface of the fire source. The working pressure of this extinguisher as already stated should be between a minimum of 10 bar and around 34 bar.

The invention is described below in more detail with reference to the enclosed drawing.

BRIEF DESCRIPTION OF THE DRAWINGS

The sole FIGURE shows diagrammatically a person with an extinguishing gun of the device according to the invention, where the extinguishing agent hose is shown broken away and the container holding the extinguishing agent has been omitted for the sake of clarity.

The arrangement or configuration of the nozzle of the extinguishing gun 1 of the extinguisher according to the invention is of particular importance. The gun 1 has a nozzle wand 2 in the form of a longitudinal tubular body projecting away from the extinguishing gun. Its front end part 3 as shown in the drawing can be angled slightly upwards for example by around 30°, and on its underside has a multiplicity of fine outlet nozzles to generate thin jets of extinguishing agent which emerge substantially perpendicular to the extinguisher head end piece 3.

Thus, as is important in extinguishing metal fires, the extinguishing gun can be held so that the extinguishing agent reaches the fire source approximately vertically from above. This applies both if the extinguishing gun is held essentially directly above the fire source and also if the extinguishing gun is held angled upwards so that the range of the extinguishing agent jet reaches some meters and the extinguishing agent jet describes a curve and reaches the burning metal approximately vertical from above.

This nozzle configuration of the extinguishing agent device according to the invention allows effective fire-fighting even on metal-working machines where metal fires occur, as the extinguishing agent can be applied effectively even in the narrowest machine gaps in which burning metal chippings can be present.

As already stated, a metal fire for example burning and, possibly liquid, sodium must be treated with extinguishing agents with great care, since the flow rate for a metal fire extinguisher must be no greater that around 30 l/minute. The working pressure of the extinguisher and the nozzle configuration must be matched to each other so that a suitable flow rate is achieved, as, only in this way, a proper extinguishing success be achieved.

The extinguisher is preferably of such a design that it can be rapidly refilled by the operator and is immediately ready for use again.

To this end, it includes a charge pressure generator or a pressure medium storage tank 5 and a container 6 for the liquid extinguishing agent which has a separate filler opening for the liquid extinguishing agent with a lid 7 which can be closed in a pressure tight manner.

The invention described above thus brings considerable advantages in fighting metal fires. By the use of a liquid extinguishing agent for fires of class D, the extinguisher can be constructed and operated very simply. Due to the special nozzle configuration, carefully metered quantities of liquid extinguishing agents are applied to the fire. Thus the surface is wetted, i.e. a true extinguishing process occurs and also the burning product and adjacent areas are cooled by the liquid extinguishing agent.

Because of the liquid extinguishing agent, metal fires can be extinguished in a targeted manner which was previously not possible. For manufacturing machine operators too it is now possible to extinguish spontaneous fires of metal chippings etc., quickly and in a targeted manner. This effectively counters the dangers which are ever present in metal fires, that is that other machines or equipment in the vicinity can catch fire because of the high combustion temperatures of the metals, as previously these fires could not be effectively extinguished using metal fire extinguishing powders.

The use of the liquid extinguishing agent also eliminates the big problem of major contamination of production machinery and plants due to the use of extinguishing powder, so that the formerly long downtimes and major clean-up work on production machinery can be avoided.

What is claimed is:

1. A fire extinguisher for extinguishing metal fires using a water-free liquid extinguishing agent which reacts with the burning metal while binding air oxygen and forming a nonflammable compound, comprising an extinguishing gun (1) with a nozzle wand (2, 3) having a plurality of small outlet nozzles arranged adjacent one another so as to form a plurality of fine jets of the extinguishing agent which can be applied to the fire source from above the fire source, the extinguishing nozzle wand (2) being an approximately tubular body with an approximately flat end piece (3) protruding from the extinguishing gun (1), in which the nozzles are arranged on one side so that the extinguishing agent jets emerge approximately perpendicular to the orientation of the end piece.

2. A fire extinguisher according to claim 1, wherein the end piece (3) of the tubular extinguishing head (2) is angled slightly upwards in relation to the remaining tubular body of the extinguishing wand (2).

3. A fire extinguisher according to claim 1, wherein, for spraying, a working pressure of around 10 to 34 bar is established.

4. A fire extinguisher according to claim 1, including charge generator pressure with a container (6) for the liquid extinguishing agent which has a separate filler opening for the liquid extinguishing agent which can be closed pressure-tight by a cap (7).

* * * * *